United States Patent [19]

Ou

[11] Patent Number: 4,754,887

[45] Date of Patent: Jul. 5, 1988

[54] NURSING BOTTLE WITH A CHECK VALVE

[76] Inventor: Mei-Yueh Ou, 10F, No. 230, Yung Chi Road, Taipei, Taiwan

[21] Appl. No.: 22,926

[22] Filed: Feb. 26, 1987

[51] Int. Cl.[4] ..... A61J 9/00; A61J 15/00

[52] U.S. Cl. ..... 215/11.4; 215/11.1

[58] Field of Search ..... 215/11 R, 11 A–E, 215/311; 137/855

[56] References Cited

U.S. PATENT DOCUMENTS

| | | | |
|---|---|---|---|
| 1,431,762 | 10/1922 | Sellers | 215/11 D |
| 2,107,442 | 2/1938 | Hughes | 215/11 D |
| 2,959,314 | 11/1960 | Sanchez | 215/11 R |
| 2,984,377 | 5/1961 | Biondi | 215/11 R |
| 3,207,349 | 9/1965 | Rabe | 215/11 R |
| 3,441,160 | 4/1969 | Levy | 215/11 R |
| 3,762,437 | 10/1973 | King, Sr. | 137/855 X |
| 3,946,888 | 3/1976 | Tonkin | 215/11 D X |
| 4,611,665 | 9/1986 | Byrne | 137/855 X |

FOREIGN PATENT DOCUMENTS

| | | | |
|---|---|---|---|
| 594286 | 5/1959 | Italy | 215/11 R |

*Primary Examiner*—William Price
*Assistant Examiner*—Sue A. Weaver

[57] ABSTRACT

The present disclosure relates to an improved nursing bottle, particularly furnished with an elongated pipette in assembly associated with a partition board having four symmetrically-disposed discharge holes thereon, each equipped with a one-way openable valve cap; both are received in a bottle and disposed under a conventional nipple-mounted cap, so that the fluid contained therein can be sucked out by a child either in a lying or standing position.

1 Claim, 3 Drawing Sheets

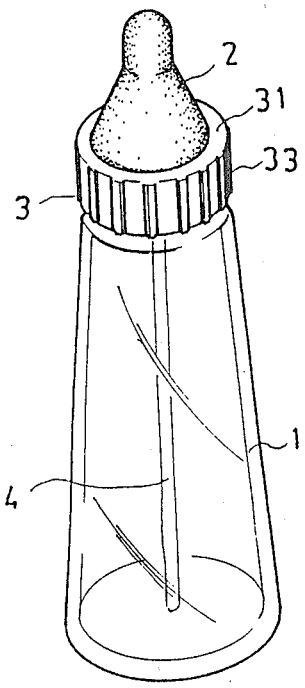
FIG.2
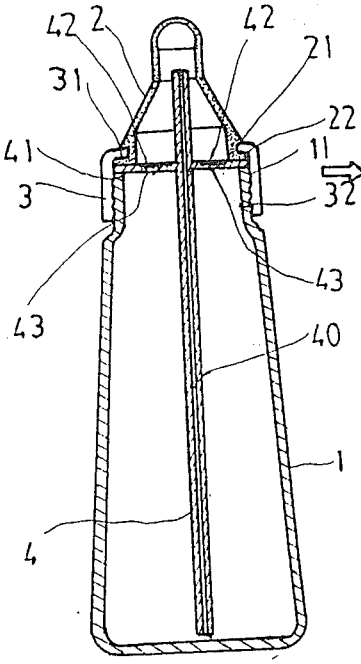
FIG.3
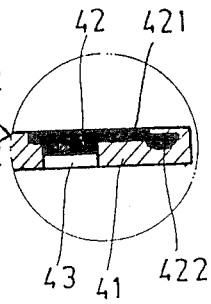
FIG.3-A
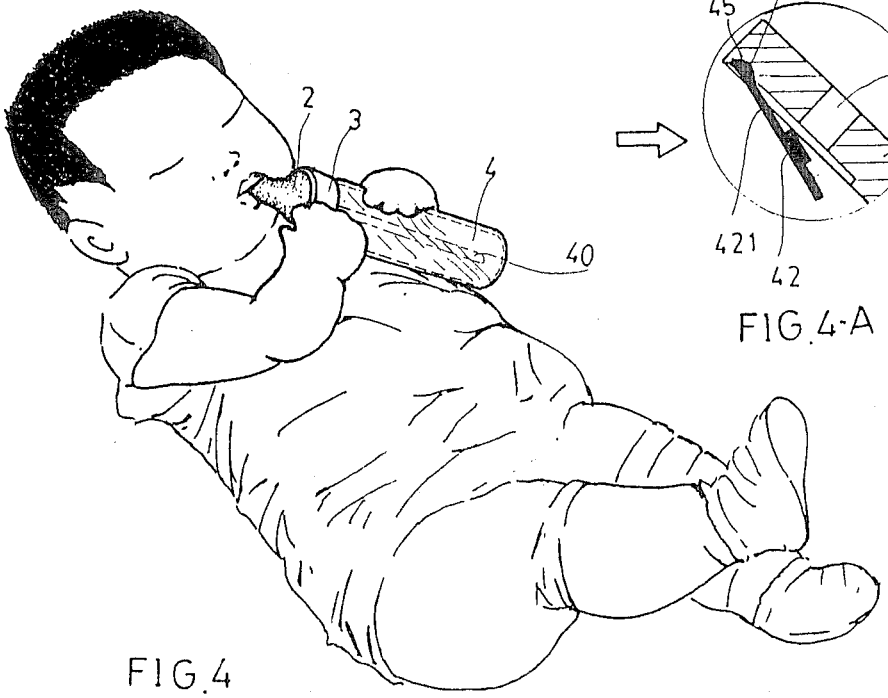
FIG.4
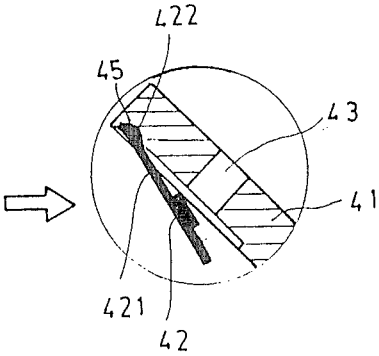
FIG.4-A

FIG. 5-A

NURSING BOTTLE WITH A CHECK VALVE

SUMMARY OF THE INVENTION

The present invention is related to an improved nursing bottle, wherein the fluid contained therein can be discharged as a result of suction by a child either in a lying or standing pose. The present bottle is so structured that it can save children from being exposed to suffocation as a result of improperly holding the nursing bottle, or trying to suck the fluid therefrom when taking a standing position.

A conventional nursing bottle is simply structured to consist of only three-parts, i.e., a bottle 1, a nipple member 2, and a cap 3 which are assembled together with said nipple member 2 being integrally attached to said cap 3 by way of a peripherally-disposed groove 21 located at the bottom 22 thereof which is engaged with the inner edge 31 of an opened top of said cap 3, permitting the disposition of said nipple therethrough; the mouth of said bottle 1 is externally threaded along its periphery to allow the attachment of said cap 3 thereto which is furnished with corresponding internal threads. In such manner, the nursing bottle is properly sealed from leakage when held upside down by a child in a lying position.

The disadvantage associated with a conventional nursing bottle is that the fluid contained therein can only be discharged by way of continuous suction on the nipple member with the bottle held as upright as possible, i.e., the bottle is held in an upside down manner so that the fluid can be accumulated at the mouth of the bottle for the maximum tendency of the liquid to flow out through an aperture at tip of said nipple member. The structure is therefore useful only to children taking a lying position, otherwise it is very awkward or inconvenient to discharge the fluid contained therein into the mouth of children taking a standing or sitting position.

One primary object of the present invention is to provide an improved nursing bottle equipped with an elongated pipette in association with a partition board having a number of holes disposed therein, each of which is provided with an one-way openable valve cap so that the fluid contained therein can be discharged into a child's mouth no matter what positions he or she takes in feeding.

One further object of the present invention is to provide an improved nursing bottle which is easily manufactured and provided with an extra elongated pipette in integral association with a partition board having a plurality of holes therein for permitting fluid contained therein to discharge therethrough, each of which is equipped with an one-way valve cap, and wherein the pipette as well as said circular board can be exchangeably disposed in any other nursing bottle readily so that a child can be fed either in a lying or standing position.

The structural features and operational modes of the present invention become clear when references are taken along with the accompanying drawings in which:

BRIEF DESCRIPTION OF THE DRAWINGS

FIG. 1A is an exploded enlarged view of the one-way valve;

FIG. 2 is a perspective view of the present invention;

FIG. 3 is a sectional view of the assembled nursing bottle of the present invention;

FIG. 3A is an enlarged view of the one-way valve in cross-section;

FIG. 4 is a view showing a baby fed in a lying position;

FIG. 4A is an enlarged view of the one-way valve in the open position;

and FIG. 5A is an enlarged view of the one-way valve in the closed position.

DETAILED DESCRIPTION

Figure 1:
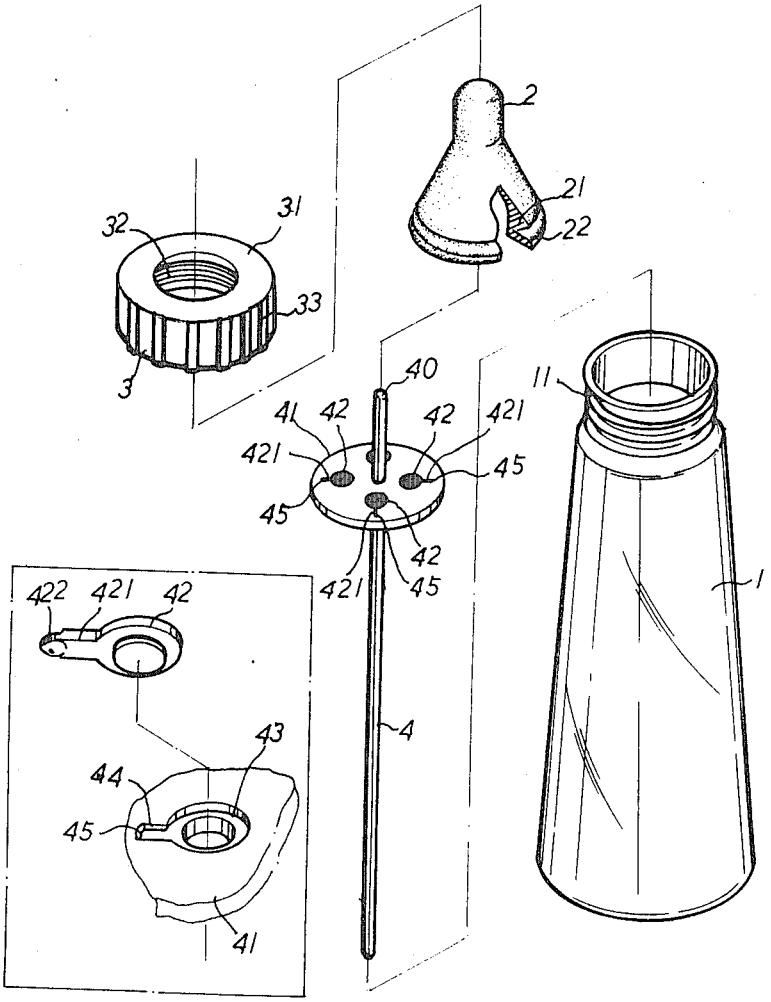
FIG. 1 is a perspective view showing the exploded components of the present invention.

Reference is first directed to FIG. 1, which shows a pipette 4 having a partition board 41 attached near the top end thereof, which has four holes 43 in the present case symmetrically spaced thereon. The present nursing bottle further comprises a nipple member 2, a cap 3 having a nipple-mounting opening disposed at the top thereof, and a bottle 1 having an externally threaded neck 11, that are all generally adopted in a conventional nursing bottle.

The nipple member 2 is provided with a peripheral groove 21 at the bottom 22 thereof which is engaged with the inner edge 31 of said opening of said cap 3, and the cap 3 is furnished with internal threads 32 on the inner surface thereof so to be able to removably engage with the externally-threaded top mouth of said bottle 1, and is also provided with vertical ridges 33 on the external surface thereof for easy grasping and rotation of said cap 3. Said pipette 4 is disposed within the bottle 1 with the partition board 41 being supported by the circular edge of the mouth of said bottle 1 and the top end of said pipette 4 housed within a space above said partition board and below said nipple member 2 as shown in FIG. 2 and FIG. 3.

Said pipette assembly including said pipette 4 having an end-to-end opening 40 therein, and said partition board 41 are clearly illustrated in FIG. 1. Said partition board 41 is symmetrically provided with four fluid discharge holes 43 which are each covered with a one way pivotably openable valve cap 42 which is shown particularly enlarged in FIG. 1. The valve cap 42 is equipped with an elongated connection 421 having a fixing end 422 in a semi-sphere form which is associately located in a semi-spherical hole 45 so that said valve cap 42 can be pivotably opened. The fluid-through hole 43 is structured in a countersink form, and the fixing hole 45 is disposed adjacent thereto connected by a recess 44, for permitting the pivotable mounting of said valve cap 42. In such a manner, the valve cap can be limitedly opened in one direction; and such opening takes place only when the nursing bottle is held upside down and the fluid contained therein flushes out therethrough into said nipple member 2 to feed the child or infant sucking thereon, as shown in FIG. 4.

Figure 5:
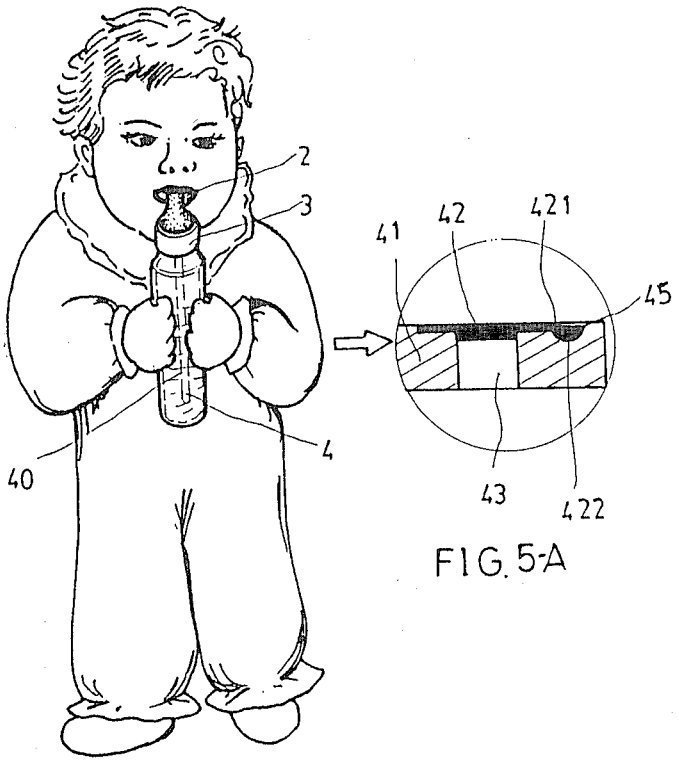
FIG. 5 is a view showing a child fed in a standing position.

As further shown in FIG. 5, a child can also be fed by way of normally holding the bottle 1 as he or she sucks on the nipple as a result of the adoption of said elongated pipette 4, so that the child can carry the bottle of the present invention around and enjoy the fluid contained therein in a normal standing pose.

I claim:

1. An improved nursing bottle which can be used by a child either in a standing or lying position, comprising a nipple member, conically shaped, having a peripheral groove disposed at the bottom thereof for engagement purpose;

a cap, having an opening top for the disposition of said nipple member therethrough with said groove in engagement with an inner edge of said opened top of the cap, and being provided with vertical protruding ridges 33 around the external surface thereof for easy turning operation of said cap which is further threaded on the inner surface for effecting the attachment of the cap to the mouth of the bottle;

a bottle, for use in containing fluid therein, being provided with external threads in registry with the inner threads on the inner surface of said cap at the top mouth thereof, with the topmost edge of said mouth being in a flat form for the purpose of supporting a partition board thereon; the present nursing bottle being characterized in:

a pipette having an end to end opening therethrough and attached with a partition board near the top end thereof which is equal in diameter to the bottom of said nipple member, and has a number of holes in a countersink form disposed thereon with an extended groove projected therefrom and a fixing hole in semi-spherical form being placed at the end of said groove for the mounting of a valve cap, the top end of said pipette being disposed just under the tip of said nipple member;

a valve cap structured in accordance with the countersink hole and provided with an elongated connection which has a semi-spherical fixing end disposed at the end thereof for registry with said fixing hole so to permit the pivotable opening of said valve cap in one way only;

whereby the present nursing bottle can be used by a child in a standing position holding the bottle in a normal manner, the fluid contained therein being discharged by way of said pipette with the bottom end thereof submerged in the fluid which is pumped out therefrom as a result of the suction on the nipple member; and the fluid also being able to be discharged via said discharge holes on said partition board with said valve cap opened when said nursing bottle is held upside down and said nipple member is sucked by a child in a lying position.

* * * * *